US007106865B2

(12) United States Patent
Pavlov et al.

(10) Patent No.: US 7,106,865 B2
(45) Date of Patent: Sep. 12, 2006

(54) SPEAKER DIAGNOSTICS BASED UPON DRIVING-POINT IMPEDANCE

(75) Inventors: Peter M. Pavlov, Plantation, FL (US); Jason D. McIntosh, Weston, FL (US); David M. Yeager, Boca Raton, FL (US)

(73) Assignee: Motorola, Inc., Schaumburg, IL (US)

( * ) Notice: Subject to any disclaimer, the term of this patent is extended or adjusted under 35 U.S.C. 154(b) by 113 days.

(21) Appl. No.: 11/012,576

(22) Filed: Dec. 15, 2004

(65) Prior Publication Data

US 2006/0126857 A1 Jun. 15, 2006

(51) Int. Cl.
*H04R 29/00* (2006.01)

(52) U.S. Cl. ..... 381/59; 381/111; 381/58

(58) Field of Classification Search ..... 381/59, 381/111, 96, 58

See application file for complete search history.

(56) References Cited

U.S. PATENT DOCUMENTS 6,064,742 A * 5/2000 Landelius ..... 381/58
6,879,693 B1 * 4/2005 Miller et al. ..... 381/60
2005/0175195 A1 * 8/2005 Cheney et al. ..... 381/120

* cited by examiner

*Primary Examiner*—Vivian Chin
*Assistant Examiner*—Jason Kurr

(57) ABSTRACT

A speaker (100) having a diagnostic capability, as well as a circuit (101) and related methods (500) for performing speaker diagnostics based upon a driving-point impedance are provided. The speaker includes a flexible cone (104) and a voice coil (106) connected to the flexible cone for driving the flexible cone so as to convert electrical signals into sound. The speaker also includes a signal source (110) connected to the voice coil for supplying a test signal to the voice coil. The speaker further includes a signal sensor (112) electrically connected to the voice coil for sensing a response signal occurring in response to the test signal. Additionally, the speaker includes a condition determining module (114) for determining a driving-point impedance based upon the response signal and for comparing the driving-point impedance to a predetermined impedance to thereby determine a condition of the speaker.

20 Claims, 5 Drawing Sheets

SPEAKER DIAGNOSTICS BASED UPON DRIVING-POINT IMPEDANCE

BACKGROUND

1. Field of the Invention

The present invention is related to the field of audio devices, and more particularly, to audio device speakers and diagnostics for determining their condition.

2. Description of the Related Art

A hallmark of modern society is the pervasive and ever-increasing use of various types of audio devices for communication, entertainment, and a host of other applications. In general, an audio device is any device capable of generating, transmitting, and/or reproducing signals at frequencies within the range of perception of the human ear, typically from about 15 to 20,000 hertz (cycles per second). While modern audio devices are primarily electrical devices, all such devices typically require one or more speakers for transforming electrical signals into acoustic sound waves. A speaker is a type of electro-acoustic transducer that converts electrical signals into sound waves. It is the part of an audio device that produces the actual sound that a person hears. The sounds are typically produced by the vibration of a synthetic, flexible cone that vibrates in response to an electrical voltage induced in a wire coil.

Not surprisingly, therefore, the condition of the speaker is an important determinant of the quality of the sound that emanates from an audio device. Indeed, if the speaker of an audio device is inoperable due to severe damage, the audio device can be rendered incapable of producing any sound regardless of how well its other components are functioning. Often times, the sound of a speaker itself can indicate a problem. At other times, though, just listening to the sound coming from a speaker can be a poor indicator of an existing or developing problem. Sound quality is basically a subjective determination that varies among different listeners.

Accordingly, it is sometimes necessary to examine a speaker directly rather than merely relying on listening to the sound emanating from the speaker. Conventional techniques for objectively determining the condition of a speaker are limited, however. Moreover, conventional speakers lack an effective and efficient self-diagnosing capability, which makes determining the condition of the speaker all the more problematic if, as is often the case, the speaker is sealed within an audio device. Especially problematic is that even high-audio radios often used by emergency personnel and first-responders typically lack of an effective and efficient technique for performing speaker diagnostics.

SUMMARY OF THE INVENTION

Embodiments in accordance with the invention provides circuits for determining the condition of a speaker having a voice coil and contained in an audio device. The circuit can include a signal source connected to the voice coil. The signal source can supply a test signal to the voice coil. The circuit also can include a signal sensor electrically connected to the voice coil. The signal sensor can sense a response signal that occurs in the voice coil in response to the test signal supplied by the signal source. The circuit further can include a condition determining module that determines a driving-point impedance based upon the response signal and that compares the driving-point impedance to a predetermined impedance to thereby determine a condition of the speaker.

A speaker according to another embodiment of the invention has a self-diagnosing capability. The speaker can include a flexible cone and a voice coil connected to the flexible cone for driving the flexible cone so as to convert electrical signals into sound and magnetic field in which the voice coil is submerged. The speaker also can include a signal source connected to the voice coil for supplying a test signal to the voice coil, as well as a signal sensor electrically connected to the voice coil for sensing a response signal occurring in response to the test signal. The speaker further can include a condition determining module for determining a driving-point impedance based upon the response signal and for comparing the driving-point impedance to a predetermined impedance to thereby determine a condition of the speaker.

Yet another embodiment of the invention pertains to a method of ascertaining a condition of a speaker contained in an audio device. The method can include supplying a test signal to a voice coil that drives the speaker. The method also can include determining a driving-point impedance from the voice coil based upon the test signal. The method further can include comparing the driving-point impedance to a predetermined impedance to thereby ascertain the condition of the speaker based upon the comparison.

BRIEF DESCRIPTION OF THE DRAWINGS

There are shown in the drawings several embodiments of the invention, it being understood, however, that the invention is not limited to the precise arrangements and instrumentalities shown.

DETAILED DESCRIPTION OF THE INVENTION

Figure 1:
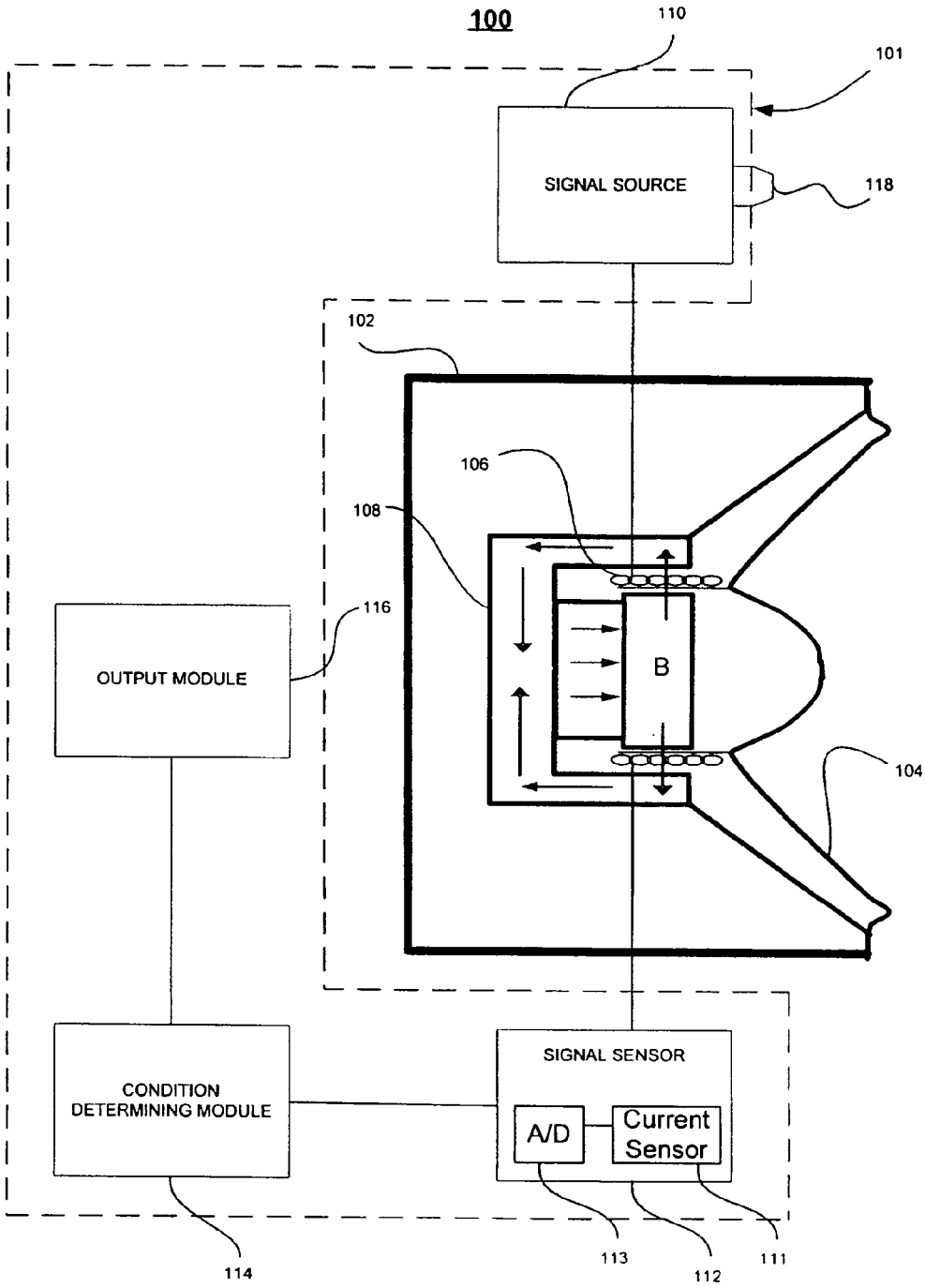
FIG. 1 is schematic diagram of a speaker having a self-diagnosing capability according to one embodiment of the invention.

FIG. 1 provides a schematic diagram of a speaker 100 having a self-diagnosing capability according to one embodiment of the invention. The speaker 100 illustratively includes a frame 102, a flexible cone 104 supported by the frame 102, and a voice coil 106 connected to the flexible cone 104 and magnetic field B in which the voice coil is submerged. The speaker 100 can be connected to or contained within an audio device (not shown). The audio device can be, for example, a high-audio radio or similar device, such as the integrated Digital Enhanced Network (iDEN) device by Motorola, Inc., of Schaumburg, Ill.

As illustrated, the voice coil 106 is positioned within a magnetic field, B, created by a permanent magnet 108 that is positioned adjacent the voice coil 106. As will be well understood by those of ordinary skill in the art, the voice coil 106 can conduct an electrical current which varies according to the fluctuations of a signal associated with a voice, music, or other input that is to be broadcast by the speaker. The electrical current induces a magnetic field around the voice coil 106, the coil-surrounding magnetic field interacting with the magnetic field B created by the permanent magnet 108 and thereby causing the voice coil 106 to move axially within the frame 102. The electromagnetically induced movement of the voice coil 106 causes the flexible cone 104 connected to the voice coil to vibrate accordingly. As will be well understood by those of ordinary skill in the art, the electrical current varies in accordance with the voice, music, or other input and thereby causes the extent and rate of vibration of the flexible cone 104 to vary accordingly so as to produce an acoustical response that corresponds to the input.

As further illustrated in FIG. 1, the speaker 100 also includes a circuit 101 comprising a signal source 110 and a signal sensor 112. The signal source 110 and signal sensor 112 are both connected to the voice coil 106. The circuit also includes a condition determining module 114 connected to the signal sensor 112. An output module 116 is connected to the condition determining module 114. The circuit 101 is illustratively activated by a push-button or switch 118 that extends externally from the speaker 100 and allows a user to selectively activate the circuit for effecting the speaker diagnostics described herein. Alternatively, however, the circuit 101 can operate as a continuously or nearly-continuously running background process for automatically performing the same speaker diagnosis.

The signal source 110 supplies a test signal to the voice coil 106, which, in turn, induces a signal response in the voice coil 106. Illustratively, the response signal is sensed by the signal sensor 112, which supplies a corresponding signal to the condition determining module 114 connected to the signal sensor 112. The signal sensor 112 can include a current sensor 111 coupled to an analog to digital converter 113. As explained below, the condition determining module 114 determines a driving-point impedance based upon the sensed response signal and compares the driving-point impedance to a predetermined impedance to thereby determine a condition of the speaker 100.

According to one embodiment, the signal supplied by the signal source 110 is a voltage, e, that is applied across the voice coil 106. As a result of this voltage, a signal response is generated in the form of a current, i, flowing through the voice coil 106. The inherent electrical resistance coupled, $R_{DC}$, with the inductance, L, induced in the coil produces two distinct voltage drops within the circuit of the speaker 100, namely, $iR_{DC}$ and $j\omega L$. The $iR_{DC}$ term corresponds to the voltage drop due to the electrical resistance, and the $j\omega L$ term is a complex value corresponding to the voltage drop due to the coil inductance.

Moreover, the inertia of the speaker and the electrically induced movements thereof create a mechanical-acoustic factor, whose electrical equivalent is referred to as the back electromotive force (emf), $e_{emf}$, of the speaker. The sum of the voltage drops, $iR_{DC}$ and $j\omega L$, in the circuit of the speaker and the electrical equivalent of the mechanical-acoustic factor, $e_{emf}$, yield the following equation:

$$e=i(R_{DC}+j\omega L)+e_{emf}.$$

Figure 2:
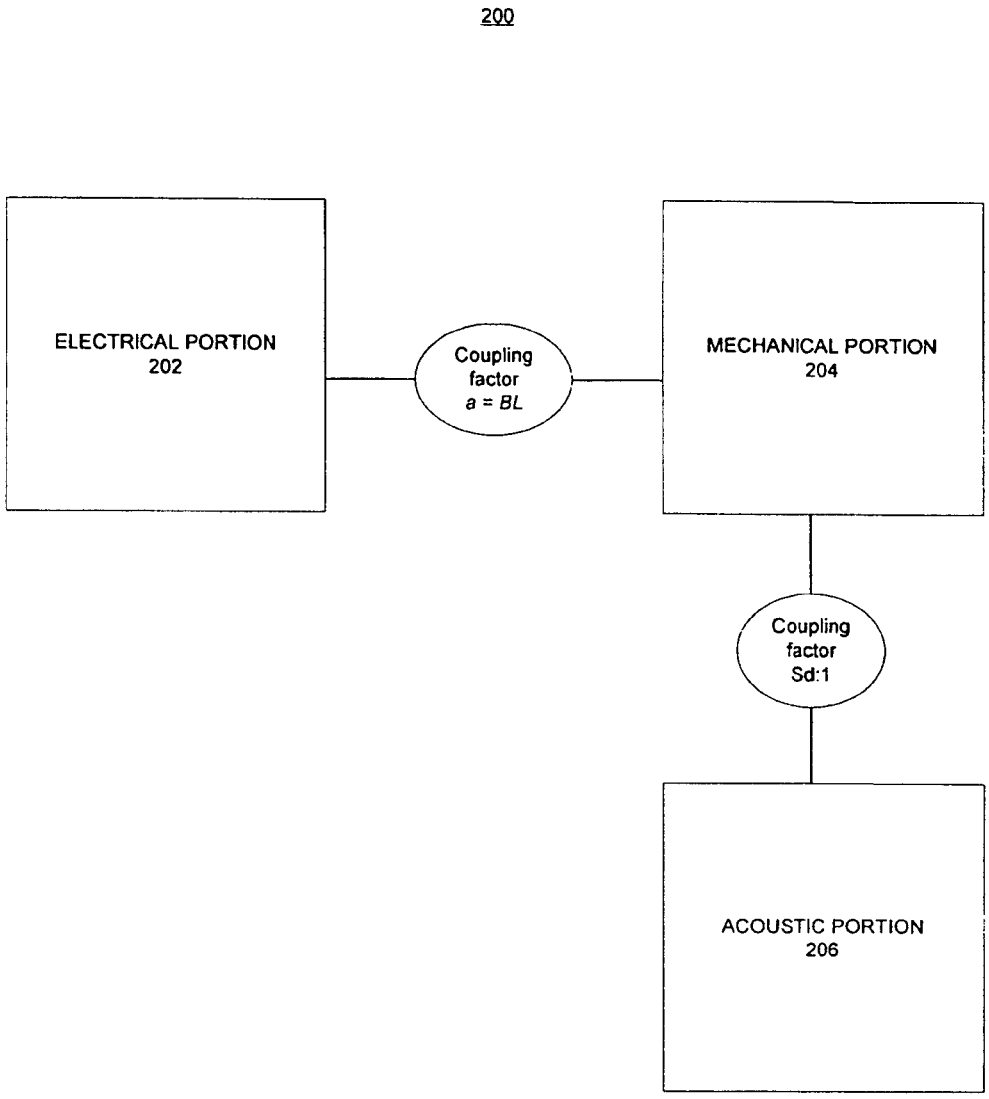
FIG. 2 is schematic diagram of the equivalent circuit Of the speaker illustrated in FIG. 1.

This equation is the basis for the utilization of the driving-point impedance as described herein and is based on a consideration of factors illustrated in FIG. 2. FIG. 2 is a schematic representation of the equivalent circuit diagram of that portion of the speaker 100 that includes the flexible cone 104, voice coil 106, and permanent magnet 108. Thus, referring additionally to FIG. 2, the equivalent circuit 200 comprises an electrical portion 202 of the speaker, a mechanical portion 204 coupled to the electrical part by a force or coupling factor, $\alpha$=BL for moving coil speaker, and an acoustical portion 206 coupled to the mechanical portion by a force or coupling factor, Sd:1. The electrical portion 202 of the speaker represents the electrical aspects, namely electrical resistance and induction, of the voice coil 106 and the permanent magnet 108. The mechanical portion 204 is based on those non-electrical factors that affect the operation of the speaker, including the friction resistance and moving mass of the voice coil and its mechanical compliance. A prominent factor of the acoustic portion is the acoustic impedance associated with the speaker. As described below and as will be readily understood by one of ordinary skill in the art, mathematical transformations can be used to convert the mechanical and acoustic portions into electrical counterparts so that they can be analyzed in conjunction with the electrical components of the speaker.

Based on the equivalent circuit 200, an equation for the driving-point impedance of the speaker 100 can be derived. Firstly, the back emf, $e_{emf}$, can be expressed in terms of a velocity of the movement of the voice coil 106 and the magnetic flux density B of the coil. Specifically, the back emf, $e_{emf}$, is:

$$e_{emf}=BLu_{vc},$$

where L is the length of the coil and $u_{vc}$ is the aforementioned velocity. Secondly, based on Newtonian mechanics, the force, f, of the movement of the voice coil 106 can be computed to be:

$$f=BLi.$$

The force can be re-written as follows:

$$f = u_{vc}\left(R_m + j\omega M_m + \frac{1}{j\omega C_m} + Z_a S_d^2\right).$$

$R_m$ corresponds to the mechanical resistance. The complex term, $j\omega M_m$ is based on the mechanical mass. The complex term $$\frac{1}{j\omega C_m}$$

is an application of Hook's law to the compliance. And $Z^a S_d^2$ is the acoustic impedance times the square of the coil surface areas A series of substitutions using the electrical equivalent terms leads to the following formulation of the above-described signal:

$$\begin{aligned} e &= i(R_{DC} + j\omega L) + BLu_{vc} \\ &= i(R_{DC} + j\omega L) + BL\frac{f}{R_m + j\omega M_m + \frac{1}{j\omega C_m} + Z_a S_d^2} \\ &= i(R_{DC} + j\omega L) + BL\frac{BLi}{R_m + j\omega M_m + \frac{1}{j\omega C_m} + Z_a S_d^2} \end{aligned}$$

-continued $$= i\left(R_{DC} + j\omega L + \frac{BL^2}{R_m + j\omega M_m + \frac{1}{j\omega C_m} + Z_a S_d^2}\right),$$

which leads, in turn, to the following formulation of the driving-point impedance:

$$Z_{e_in} = e/i = R_{DC} + j\omega L + \frac{BL^2}{R_m + j\omega M_m + \frac{1}{j\omega C_m} + Z_a S_d^2}.$$

In the last equation, the voltage, e, as already described, corresponds to the test signal supplied to the voice coil 106 by the signal source 110. The current, i, as also described, corresponds to the response signal sensed by the signal sensor 112. On the basis of the ratio of these two values, e and i, the condition determining module 114 determines the driving-point impedance. As described hereinafter, the speaker 100 utilizes the physical properties underlying the last of the above series of equations to perform a self-diagnosis. More particularly, various abnormal conditions in the speaker, if the exist, affect the mechanical and acoustic performances of the speaker. As demonstrated in the equivalent circuit 200, the mechanical and acoustic performances of the speaker determine the third term on the right-hand side of the last equation, which is the term corresponding to the back emf, $e_{emf}$:

$$\frac{BL^2}{R_m + j\omega M_m + \frac{1}{j\omega C_m} + Z_a S_d^2}.$$

Accordingly, various abnormal conditions, in turn, affect the value of the driving-point impedance, which, as demonstrated above, includes this last term. As described below, by comparing the driving-point impedance to a predetermined driving-point impedance, the speaker 100 is able to effect a self-diagnosis.

For example, if the speaker 100 is completely disabled, in the sense that the flexible cone 104 is somehow hindered from any movement, then the result is that the velocity $u_{vc}$ of the voice coil 106 is zero. Recalling from the above equations that the back emf, $e_{emf}$, can be written as a function of the velocity, $e_{emf}=BLu_{vc}$, it follows therefore that the third term in the right-hand side of the driving-point impedance equation is zero. Since the condition of the speaker affects the mechanical-acoustic performance of the speaker, which, in turn, affects the back emf, $e_{emf}$, term in the above-expressed driving-point impedance equations, it follows that the driving-point impedance can be compared by the condition determining module 114 to a predetermined impedance so as to determine the condition of the speaker 100.

Figure 3:
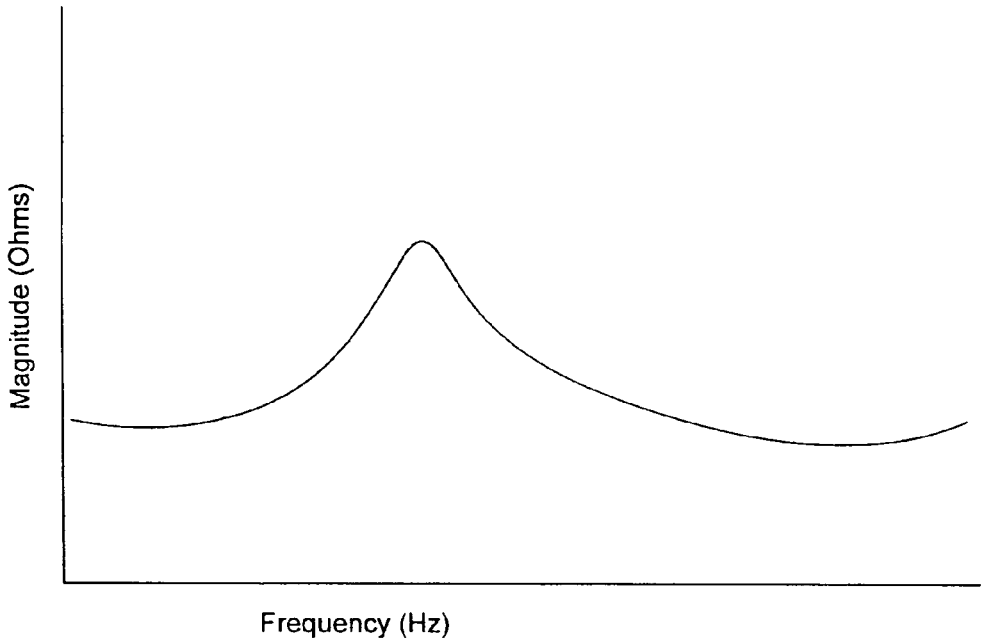
FIGS. 3 and 4 are semi-logarithmic plots illustrative of the impedance magnitude and phase profiles, respectively, of a well functioning speaker in accordance with an embodiment of the invention.
Figure 4:
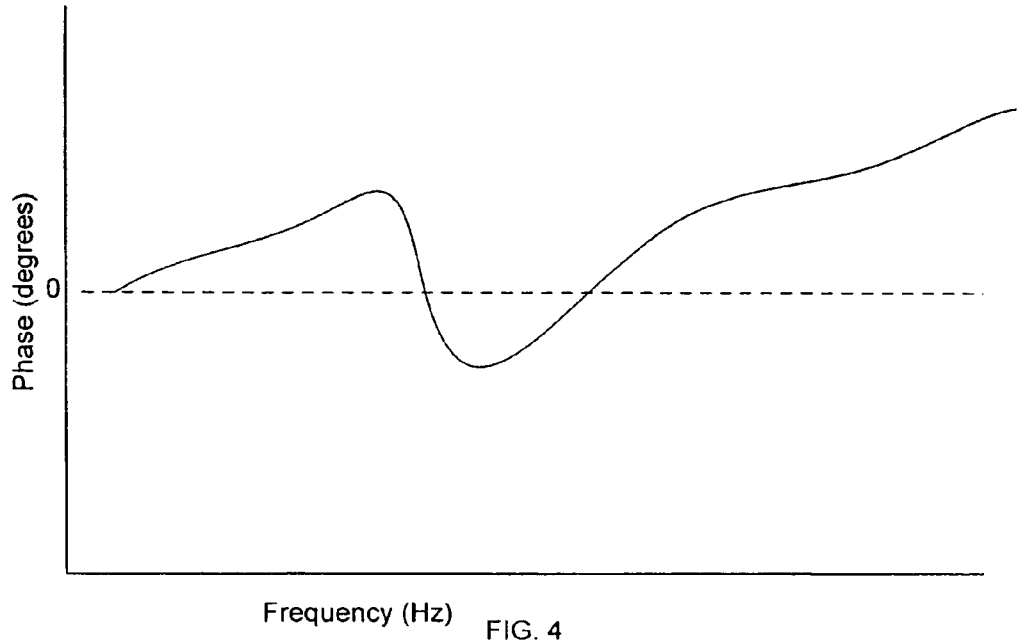

For example, a normal impedance in terms of a frequency-based magnitude typically resembles the exemplary profile shown in FIG. 3. As illustrated, a normal profile of the magnitude shows a pronounced peak at the resonance frequency. The corresponding frequency-based phase profile is shown in FIG. 4, where a zero crossing at the resonance frequency is clearly evident.

Figure 5:
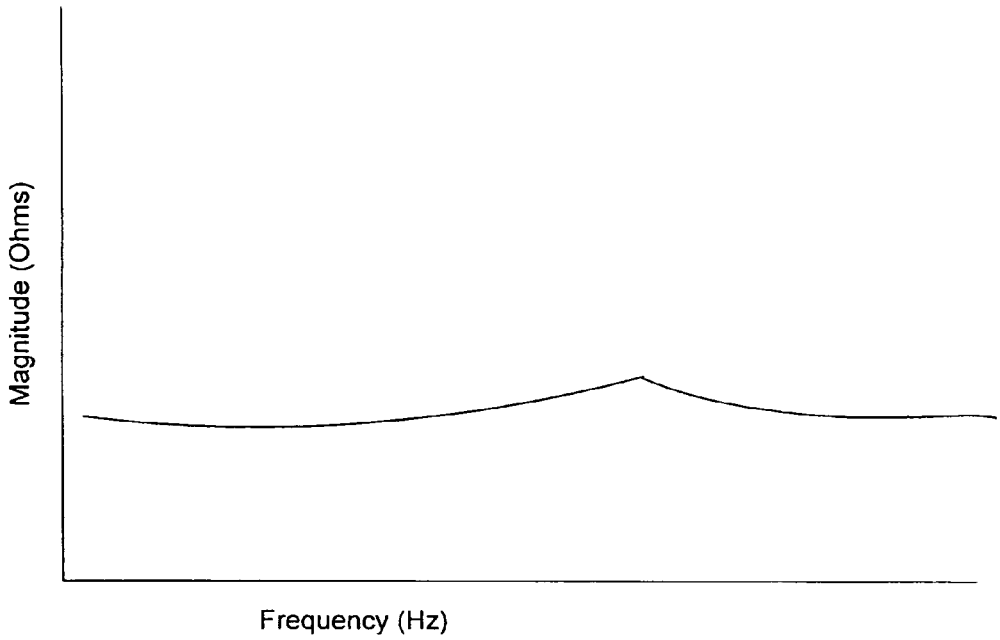
FIGS. 5 and 6 are semi-logarithmic plots illustrative of the impedance magnitude and phase profiles, respectively, of a malfunctioning speaker in accordance with an embodiment of the invention.
Figure 6:
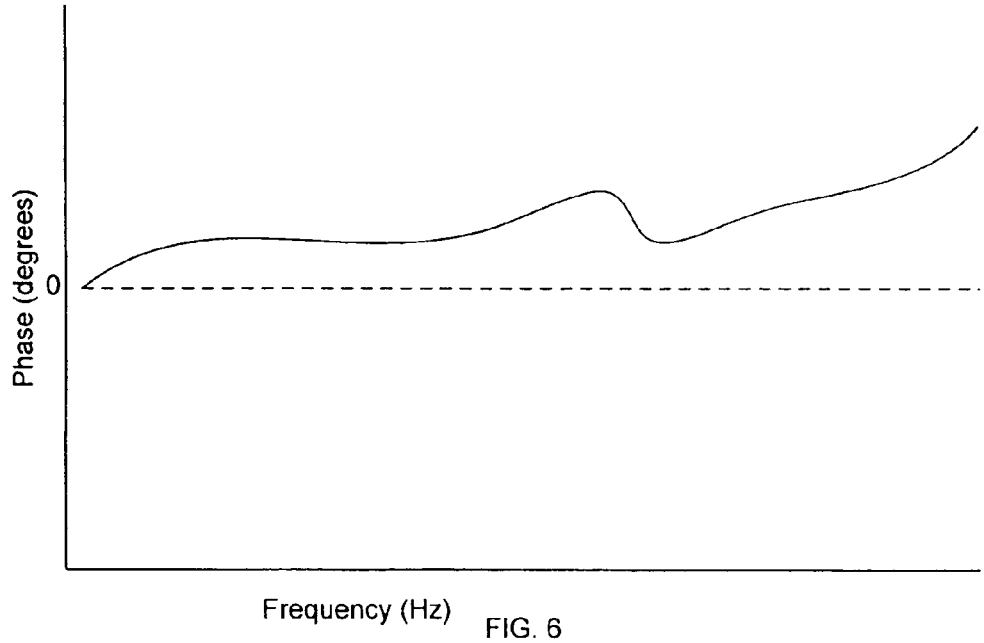

By contrast, FIG. 5 provides an exemplary impedance profile of the frequency-based magnitude for a speaker in which the flexible cone 104 is not mechanically able to move or, by reason of an electrical short, does not move. This can be characterized as a voice-coil short. In this event, the velocity $u_{vc}$ of the voice coil 106 is zero. As already explained, this affects the back emf, $e_{emf}$, term of the driving-point impedance equation. This is reflected in the frequency-based magnitude profile, which, as compared to that illustrated in FIG. 3, clearly lacks a pronounced peak. Similarly, the frequency-based phase profile of the improperly functioning speaker shown in FIG. 6 also contrasts sharply with the phase profile illustrated in FIG. 4. The frequency-based phase profile of the improperly functioning speaker lacks a zero crossing.

Other abnormal conditions that may occur in the speaker 100 will similarly affect the mechanical-acoustic performance and thus likewise be reflected in the driving-point impedance. For example, even if the flexible cone is only partially blocked, this condition, too, will be reflected in the back emf, $e_{emf}$, term of the above-expressed driving-point impedance equations. In this case, designated as a partial voice-coil short, the driving-point impedance at the resonance frequency is substantially reduced in comparison with that which would be obtained in response to the test signal supplied by the signal source 110 were the speaker 100 functioning normally.

Yet another exemplary abnormality is the misalignment of the flexible cone 104 and/or voice coil 106 within the frame 102. Misalignments adversely affect the flexing of the cone and/or axial movement of the voice coil 106, each of which affects the back emf, $e_{emf}$, term of the previously-described driving-point impedance equations. Again, the result is a driving-point impedance different from that which obtains when the speaker functions normally. Thus, a comparison of the driving-point impedance induced by the test signal with a predetermined impedance reveals malfunctions in the speaker 100 due to such misalignments.

Still another example of the abnormalities revealed by the comparison pertains to what can be termed a voice-coil open, which produces an infinite impedance. This event can also be revealed by comparing the driving-point impedance to a threshold that would otherwise obtain were the speaker 100 function normally. As this and the earlier examples illustrate, the driving-point impedance can be compared by the condition determining module 114 to a predetermined impedance so as to determine the condition of the speaker 100.

According to one embodiment, the comparison performed by the condition determining module 114 comprises comparing the driving-point impedance at the resonance frequency with a predetermined resonance impedance expected for a comparable speaker functioning normally. For example, the predetermined resonance frequency can comprise a lower threshold, which if the driving-point impedance is less than, indicates a malfunction along the lines described above. The predetermined resonance additionally, or in lieu of a lower threshold, can comprise an upper threshold that corresponds to the maximum that a normally functioning speaker would be expected to exhibit in response to the test signal. If the upper threshold is exceeded by the driving-point impedance, a possible voice coil open is indicated, as also explained above.

In still another embodiment, the comparison performed by the condition determining module 114 is based upon the phase measured for the driving-point impedance. A determination is made based upon the presence or absence of a zero crossing, as already described.

According to yet another embodiment, the comparison performed by the condition determining module 114 comprises determining a driving-point impedance profile of the type illustrated in FIGS. 3–6. This profile is compared by the condition determining module 114 to a predetermined profile corresponding to a normally functioning speaker. Again, as already described, the compared profiles can both be based upon the respective magnitudes of the impedances and/or their measured phase angles.

The source signal 110 according to one embodiment provides a single test signal that induces the response on which the condition determining module 114 obtains the driving-point impedance. According to an alternate embodiment, the source signal 110 provides a plurality of test signals, each at different frequencies. With respect to the multiple-frequency test signals, the source signal 110 can, more particularly, generate a frequency sweep. Alternately, however, the test signal can be a broadband signal, such as broadband noise. The broadband signal can be a low-power signal. A low-level broadband signal, such as broadband noise, need not be an audible signal to accomplish the intended function. Alternatively, the received speech can be used as a test signal and no additional signal generation is necessary (will need a lot more averaging)

The signal sensor 112, according to one embodiment, can comprise a current sensor 111. In still another embodiment, the signal sensor 112 or current sensor 111 can be coupled to an analog-to-digital converter 113 that that generates a digital signal based on the sensed analog signal. The digital signal is provided by the signal sensor to the condition determining module 114.

According to one embodiment, if a digital signal is provided, then the condition determining module 114 can be configured to process the digital signal using one or more digital signal processing techniques. The digital signal processing, for example, can include computing one or more inverse fast Fourier transforms (IFFT) based upon the supplied digital signal. The condition determining module 114 can be implemented in software configured to run on processing components contained within the speaker 100 and/or within the audio device in which the speaker is used. Alternately, the condition determining module 114 can be implemented in one or more hardwired dedicated circuits. In still another embodiment, the condition determining module 114 can be implemented as a combination of software-based instructions and one or more dedicated circuits.

The output module 116, according to one embodiment, generates an output indicating a condition of the speaker 100. As noted above, the circuit can perform a diagnostic function selectively in response to a user instruction, Such as the user's pushing the external push-button 118, or alternatively, as part of a continuously or near-continuously running background process. For example, in response to a user initiation, the circuit 101 can perform its diagnostic functions and, in response thereto, the output module 116 can generate a user-observable signal, such as short beep or chirp at a pre-selected frequency. Alternately, if the circuit 110 is configured to run a background procedure, an output can be generated only when the speaker 100 is diagnosed as likely having an abnormality. Moreover, an audible output at a particular frequency can indicate a particular problem with the speaker 100, according to one embodiment. Thus, according to this embodiment, a user is able to ascertain the condition of the speaker on the basis of the particular sound emitted by the output module 116.

Figure 7:
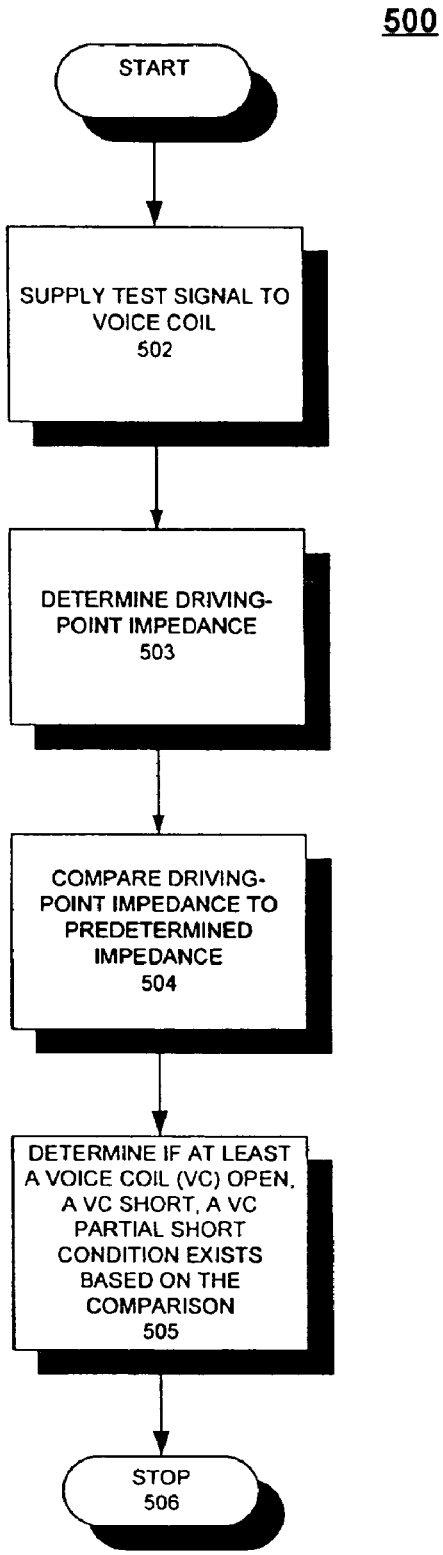
FIG. 7 is flowchart of a method for determining a condition of a speaker according to another embodiment of the present invention.

FIG. 7 illustrates a method according to still another embodiment of the invention. The method pertains to ascertaining the condition of a speaker contained in an audio device. The method 500 includes, at step 502, supplying a test signal to a voice coil that drives the speaker. The test signal supplied can comprise, for example, a plurality of test signals each having a different frequency selected from a range of frequencies. Alternatively, the test signal can comprise a broadband signal, such as low-power broadband noise.

The method 500 illustratively continues at step 503 with the determining of a driving-point impedance of the voice coil based upon the test signal. More particularly, the test signal can be a voltage that induces a current to flow through the voice coil. The impedance, therefore, can be a complex value based on the ratio of the voltage to the current.

At step 504, the driving-point impedance is compared to a predetermined impedance to thereby ascertain the condition of the speaker based upon the comparison. The predetermined impedance can be, for example, an impedance profile. According to one embodiment, the impedance profile spans a range of frequencies. Alternatively, the predetermined impedance can comprise one or more thresholds. A threshold can comprise, for example, a resonance impedance phase zero crossing, a resonance impedance magnitude, or a resonance infinite-impedance magnitude approximation. At step 505, the comparison can be used to determine whether a voice-coil short, a partial voice-coil short, or a voice-coil open exists in the speaker. Finally, the method 500 concludes at step 506.

As noted already, embodiment of the invention can be realized in hardware, software, or a combination of hardware and software. Embodiments can be realized in a centralized fashion in one computer system, or in a distributed fashion where different elements are spread across several interconnected computer systems. Any kind of computer system or other apparatus adapted for carrying out the methods described herein is suited. A typical combination of hardware and software can be a general purpose computer system with a computer program that, when being loaded and executed, controls the computer system such that it carries out the methods described herein.

Embodiment in accordance with the invention also can be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

Embodiments herein, moreover, can be embodied in other forms without departing from the spirit or essential attributes thereof. Accordingly, reference should be made to the following claims, rather than to the foregoing specification, as indicating the scope of the invention.

That which is claimed is:

1. A method of ascertaining a condition of a speaker contained in an audio device, the method comprising:

supplying a test signal to a voice coil that drives the speaker;

determining a driving-point impedance from the voice coil based upon the test signal; and comparing the driving-point impedance to a predetermined impedance to thereby ascertain the condition of the speaker based upon the comparison.

2. The method of claim 1, wherein the predetermined impedance comprises an impedance profile.

3. The method of claim 1, wherein the predetermined impedance comprises at least one threshold to which the driving-point impedance is compared.

4. The method of claim 3, wherein the at least one threshold comprises at least one of a resonance impedance phase zero-crossing, a resonance impedance magnitude, and a resonance infinite-impedance magnitude approximation.

5. The method of claim 1, wherein supplying a test signal comprises supplying a plurality of test signals, each of the plurality of test signals having a different frequency selected from a range of frequencies.

6. The method of claim 1, wherein supplying a test signal comprises supplying a low-power broadband signal.

7. The method of claim 1, further comprising determining if at least one of a voice-coil open, a voice-coil short, and a voice-coil partial short condition exists based upon the comparison.

8. A circuit for determining a condition of a speaker having a voice coil and contained in an audio device, the circuit comprising:

a signal source connected to the voice coil for supplying a test signal to the voice coil;

a signal sensor electrically connected to the voice coil for sensing a response signal occurring in response to the test signal; and a condition determining module for determining a driving-point impedance based upon the response signal and comparing the driving-point impedance to a predetermined impedance to thereby determine a condition of the speaker.

9. The circuit of claim 8, wherein the predetermined impedance comprises an impedance profile.

10. The circuit of claim 8, wherein the predetermined impedance comprises at least one threshold to which the driving-point impedance is compared.

11. The circuit of claim 10, wherein the at least one threshold comprises at least one of a resonance impedance phase zero-crossing, a resonance impedance magnitude, and a resonance infinite-impedance magnitude approximation.

12. The circuit of claim 8, wherein the test signal supplied by the signal source comprises a low-power broadband signal.

13. The circuit of claim 8, wherein the signal supplied by the signal source comprises a plurality of test signals, each of the plurality of test signals having a different frequency selected from a range of frequencies.

14. The circuit of claim 13, wherein the plurality of test signals are part of a frequency sweep performed by the signal source.

15. The circuit of claim 8, wherein the signal sensor comprises a current sensor coupled to an analog-to-digital converter for supplying a digital signal to the condition determining module, and wherein the condition determining module is configured to process digital signals.

16. The circuit of claim 14, wherein the condition determining module is configured to compute an inverse fast Fourier transform.

17. A self-diagnosing speaker for an audio device, the speaker comprising:

a flexible cone;

a voice coil connected to the flexible cone for driving the flexible cone to thereby convert electrical signals into sound;

a signal source connected to the voice coil for supplying a test signal to the voice coil;

a signal sensor electrically connected to the voice coil for sensing a response signal occurring in response to the test signal; and a condition determining module for determining a driving-point impedance based upon the response signal and comparing the driving-point impedance to a predetermined impedance to thereby determine a condition of the speaker.

18. The self-diagnosing speaker of claim 17, further comprising an output module in communication with the condition determining module for generating a user-observable output indicating to a user the condition of the speaker.

19. The self-diagnosing speaker of claim 18, wherein the user-observable output comprises an audio output.

20. The self-diagnosing speaker of claim 17, wherein the test signal comprises at least one of a plurality of test signals each having a different frequency selected from a range of frequencies and a low-power broadband signal.

* * * * *